United States Patent [19]

Johnson et al.

[11] Patent Number: 4,758,126

[45] Date of Patent: Jul. 19, 1988

[54] PLATE FEED APPARATUS

[76] Inventors: Peter E. Johnson, 5000 Crescent Valley Dr.; David A. Johnson, 2120 NW. Maser Dr., both of Corvallis, Oreg. 97330

[21] Appl. No.: 16,350

[22] Filed: Feb. 19, 1987

[51] Int. Cl.[4] ..... B65H 5/12

[52] U.S. Cl. ..... 414/330; 221/211; 271/12; 271/31.1; 414/123; 414/907

[58] Field of Search ..... 414/121, 123, 129, 330, 414/907; 271/12, 31.1, 94, 95, 105, 106; 221/39, 211

[56] References Cited

U.S. PATENT DOCUMENTS

| | | | |
|---|---|---|---|
| Re. 21,489 | 9/1940 | Kleineberg et al. | 271/31.1 X |
| 3,148,876 | 9/1964 | Chandler et al. | 271/12 |
| 3,894,732 | 7/1975 | Müller | 271/105 X |
| 4,042,235 | 8/1977 | Wanner et al. | 271/94 |
| 4,462,745 | 7/1984 | Johnson | 414/330 |

OTHER PUBLICATIONS

IBM Technical Disclosure Bulletin, vol. 16, No. 2, pp. 481 & 482; Jul. 1973.

*Primary Examiner*—Leslie J. Paperner

*Attorney, Agent, or Firm*—Chernoff, Vilhauer, McClung & Stenzel

[57] ABSTRACT

The plate feed apparatus of the present invention is comprised of a cylindrical carrier having air inlet holes located in its periphery which are connected to a vacuum source. A stack of plates is fed toward the carrier on a conveyor belt and each time one of the air inlet openings becomes aligned with the plates the front plate in the stack becomes affixed to the carrier and is rotated with it away from the stack. The plates then are released from the carrier for further handling. In order to prevent the plate being carried from striking the remaining plates a gap must be provided between them. In one embodiment this is accomplished by locating rollers, whose axes are parallel with the axis of the carrier, at the periphery of the carrier in positions which are rotationally ahead of the air inlet openings. In a second embodiment a pair of levers are mounted rotatably outwardly of the carrier sides. Rollers contact the levers at the proper rotational orientation of the carrier and rotate them rearwardly so that they contact the plates and move them away from the carrier. A return spring pulls the levers back toward the carrier. In both embodiments the forwardmost plate becomes free to move back toward the carrier as the air inlet opening becomes aligned with the plates. The vacuum then pulls the forward plate away from the stack thereby creating the necessary gap between it and the rest of the plates in the stack.

7 Claims, 1 Drawing Sheet

PLATE FEED APPARATUS

BACKGROUND AND SUMMARY OF THE INVENTION

This invention relates to an apparatus for feeding individual rigid plates sequentially out of a stack of plates for separate processing.

In many industrial operations it is necessary to remove rigid plates from a stack and deliver them serially to another location. One method for accomplishing this is to use a vacuum source to adhere the first plate in the stack to a cylindrical carrier which pulls the first plate away from the stack as the carrier rotates. Then when the plate is at the desired location it is deposited by discontinuing the vacuum. The primary problem with using cylindrical carriers for this purpose is that when a rigid plate is removed from a stack the trailing edge of the plate being removed strikes the remaining plates in the stack which disorients the stack and can dislodge the plate being removed. Thus, the plate being carried must be displaced away from the remaining plates in the stack before the carrier is rotated.

This is accomplished by the plate feed apparatus disclosed in U.S. Pat. No. 4,462,745 by creating a cordal segment in the carrier at the location of the air inlet through which the vacuum is drawn. The remainder of the periphery of the carrier then acts as a stop to keep the stack of plates separated from the cordal segment until it becomes aligned with the plates. When the cordal segment does become aligned with the stack the vacuum pulls the front plate in the stack away from the remaining plates up to the cordal segment thereby providing the gap which is necessary to enable the plate to be rotated without striking the remaining plates in the stack. While this apparatus works well to separate plates, as the carrier rotates it rubs on the forwardmost plate in the stack which can cause the plate to become scarred.

What is needed, therefore, is to create the necessary gap between the plate being removed and the rest of the stack while still providing a constant supply of plates in the proper position for removal, without having the rotating carrier rub on the forwardmost plate.

This is accomplished in the present invention by providing a mechanism which is separate from the carrier but which is operably timed by the rotation of the carrier to push the front portion of the stack away from the periphery of the carrier before the vacuum source air inlet opening becomes aligned with the plates. Since the periphery of the carrier is not being utilized to create the gap between the plates and the air inlet opening, the feed mechanism does not need to push the plates up against the carrier and thus they do not rub on the carrier as it rotates.

In a first embodiment of the invention the plates are separated from the carrier by the proper distance by means of rollers which protrude from the periphery of the carrier. One roller is provided for each vacuum inlet opening and it is angularly offset from its associated opening by a 60 degree angle in order that it will be clear of the plate when the plate is in a position to be pulled toward the carrier by the vacuum.

In a second embodiment of the invention a pair of levers are mounted rotatably on the frame of the apparatus outwardly of the sides of the carrier. The levers are arranged to contact the edges of the plate when they are rotated away from the carrier and fit behind the carrier free from the plates when they are rotated toward the carrier. A pair of rollers, one located on each side of the carrier, controls the levers and rotates them forwardly to a first position where the forwardmost plate is separated from the periphery of the carrier by the proper gap before the inlet opening comes into alignment with the plates. Return springs rotate the levers rearwardly to a second position behind the periphery of the carrier when the rollers are not pushing them forward.

In both embodiments a first idler roller is located on the side of the carrier opposite the feed mechanism, with the top of the first idler roller being generally horizontally aligned with the top of the carrier. A belt is wrapped around the first idler roller and the carrier and thus rotates with the carrier to lift the plates being carried by the carrier off of it as they reach its top and transport them to the end of the conveyor belt where they are deposited for further processing. Mounted above the first idler roller is a second idler roller. The idler rollers are separated from one another by a distance that causes the plates to be squeezed between them. As a result the plates remain horizontal until they drop from the rollers.

Accordingly, it is a principal object of the present invention to provide a plate feed apparatus having a rotary carrier in which a uniform gap is created between the plate which is being carried by it and the stack of plates from which it was extracted.

It is a further object of the present invention to provide such a plate feed apparatus in which the gap is not created by the periphery of the carrier itself.

It is a yet further object of the present invention to provide a plate feed apparatus in which the plates are lifted off of the carrier automatically and uniformly at a certain point in its rotation.

It is a still further object of the present invention to provide such a plate feed apparatus where the plates are transported and discharged from the apparatus horizontally after they have been removed from the carrier.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 2:
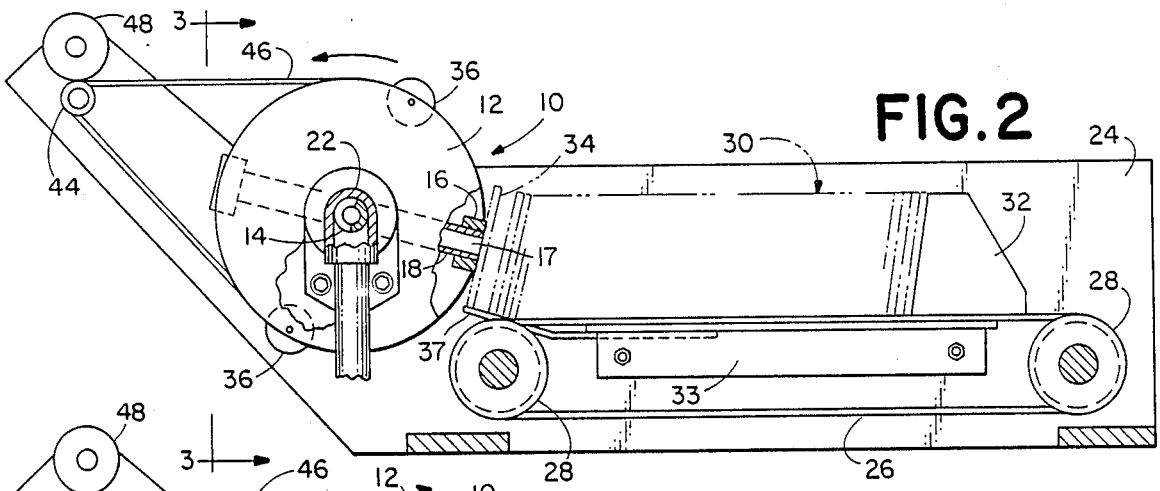
FIG. 2 is a sectional view taken along the line 2—2 of FIG. 1.

Referring to the drawings, the plate feed apparatus of the present invention includes a cylindrical carrier 10, which in the embodiment illustrated includes a pair of spaced apart wheels 12. The wheels are joined at their centers by a cylindrical pipe 14, and at two 180-degree opposed locations on their pheripheries by rectangular pads 16. Located in the outer face of each pad 16 is an air inlet opening 17, and tubes 18 fluidly interconnect the air inlet openings and the pipe 14. The pipe 14 is rotatably journaled in bearing blocks 20 located on each side of the carrier and is connected to a vacuum source (not shown) through a supply line 21 and swivel joint 22. The carrier is rotated by means of a motor (not shown) operating through a conventional drive system. The bearing blocks 20, which support the carrier, are mounted on a frame 24 which also carries a plate feed means.

In the embodiment illustrated the plate feed means comprises a pair of parallel conveyor belts 26 which are supported at each end by pulleys 28. The conveyor belts are spaced apart from one another by an amount such that they contact the edges of a stack of plates 30 which are supported on end by the belts. The conveyor belts are driven by a motor (not shown) to continuously urge the stack of plates toward the carrier. The speed of the motor is such that the stack of plates is moved toward the carrier at approximately the same rate that plates are being removed from the stack, however, as will be more fully explained below, the exact placement of the plates relative to the carrier is not accomplished by the plate feed means and thus feed rate is not overly critical. The conveyor belts are smooth so that the plates will slip on them to prevent the stack from being compressed in the event that the feed system continues to operate after the conveyor is stopped. A push bar 32 is placed on the conveyor belts behind the stack to keep the plates in the stack from falling over. Located beneath each of the conveyor belts is a support rack 33 which prevents them from sagging under the weight of the plates.

The feeder uses the vacuum being drawn through the inlet openings 17 to hold the forwardmost plate 34 in the stack 30 in contact with the pad 16 each time one of the pads 16 becomes aligned with its stack. As the carrier then rotates the plate 34 is pulled away from the stack and will be deposited at another location for further processing. In order to prevent the plate being removed from striking the remaining plates in the stack as it is pulled away by the rotating carrier, a gap must be provided between the plate 34 and the remaining plates in the stack. The apparatus of the present invention creates this gap by forcing the forwardmost plate back toward the stack, thus compressing the stack, immediately before one of the pads 16 becomes aligned with the plates. The vacuum then pulls the forwardmost plate 34 away from the remaining plates in the stack thereby creating the required gap between them.

Figure 1:
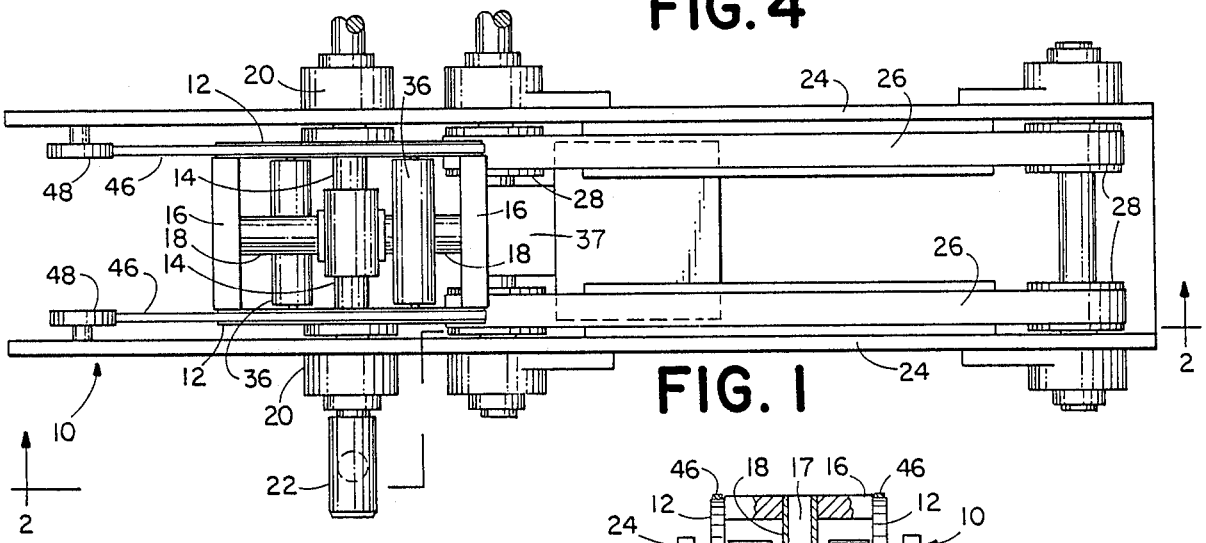
FIG. 1 is a plan view of a plate feed apparatus embodying the features of the present invention.
Figure 3:
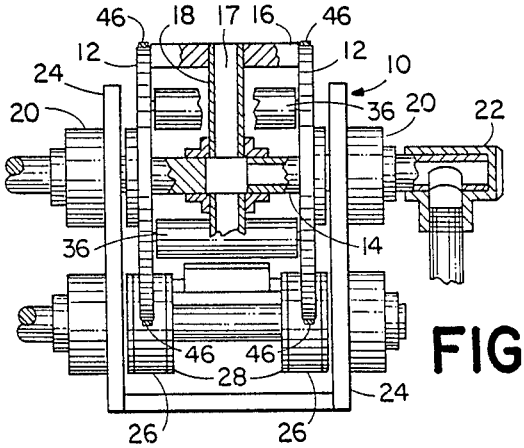
FIG. 3 is a sectional view, taken along the line 3—3 in FIG. 2, partially broken away to show hidden detail.

This is accomplished in a first embodiment of the invention, FIGS. 1, 2 and 3, by a pair of rollers 36 which are mounted between the plates. The rollers protrude from the peripheries of the plates by a distance which is slightly greater than the gap which must be provided between the pads 16 and the stack to prevent the forwardmost plate from striking the stack when it is attached to the carrier and rotated with it. In order to provide the proper timing the rollers are located such that a line extending between the center line of each roller and the center of the carrier 10 is angularly offset from the center line of the associated pad 16 by approximately 60 degrees. In this embodiment of the invention a shelf 37 is located between the belts to align the plates as they approach the carrier. The exit portion of the shelf is at an angle with respect to the belts which causes the plates at the front of the stack to be tilted slightly so that they will be aligned with the pads 16 at the time they are pulled away from the stack.

Figure 4:
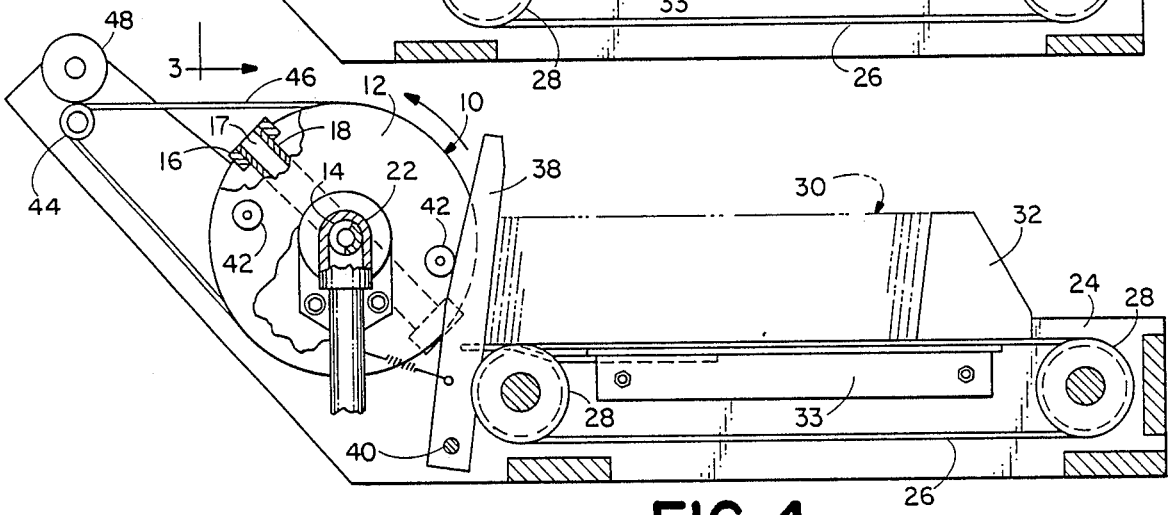
FIG. 4 is a sectional view, similar to FIG. 2 of another embodiment of the invention.

In a second embodiment of the invention, FIG. 4, the stack of plates is compressed by a pair of levers 38 which are pivotally attached to the frame 24 by means of pins 40. The levers are separated by a distance which permits them to be located on each side of the carrier wheels 12 and still contact the side margins of plates located in the stack. Thus, when the levers are rotated in one direction they push the first plate in the stack rearwardly with respect to the stack so that it is separated from the periphery of the carrier, and when they are rotated in the opposite direction they permit the first plate to come into contact with the stack.

Rollers 42, which extend outwardly from the sides of the wheels 12 engage the levers and move them to a first position, shown in FIG. 4, where the proper gap is created between the periphery of the carrier and the first plate in the stack before one of the pads 16 becomes aligned with it. Springs 44 then pull the levers back to a second position behind the periphery of the carrier when the rollers 42 have rotated past them to permit the plate to be drawn up to the carrier.

In both embodiments the conveyor belts are timed to feed the stack of plates at a rate such that the forward plate almost contacts the periphery of the carrier at the time that it is to be removed from the stack. The rollers 36 or levers 38 then move the forwardmost plate back toward the stack, thereby compressing the stack, in order to create the necessary gap between the plate and the periphery of the carrier just before the pad 16 comes into alignment with the plates. The forwardmost plate then is pulled away from the remaining plates in the stack by the vacuum in the air inlet opening 17 so that it will not strike the remaining plates as it is rotated away from them.

Mounted rotatably on the frame, on the opposite side of the carrier than the feeder, is an idler roller 44. The upper periphery of the idler roller is generally horizontally aligned with the upper periphery of the carrier and a continuous belt 46 fits tightly around them. Thus when a plate which is being held by vacuum on the pad 16 rotates to the top of the carrier the belt prevents it from continuing to rotate with the carrier and it instead moves horizontally with the belt. As a result the plates are removed from the carrier sequentially in a positive predictable manner. A conveyor (not shown) is positioned adjacent to the idler roller 44 to continue to transport the plates to the next processing station once they pass off the end of the belts 46. Located above the idler roller 44, by a distance which is slightly less than the thickness of one of the plates, is a second idler roller 48. The plates are squeezed between the two idler rollers as they pass off the end of the belt thereby remaining substantially horizontal until they are clear of the idler rollers. Without the second idler roller the plates would tend to tip downwardly as they pass off of the end of the belt 46.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A plate feed apparatus for sequentially removing individual plates from a stack of plates, said apparatus comprising:

(a) a cylindrical carrier which rotates about a central axis and which has at least one air inlet opening on its periphery;

(b) feed means for moving said stack of plates toward said carrier;

(c) means associated with said carrier for compressing said stack of plates sufficiently to position the forwardmost plate in said stack a predetermined distance from the periphery of said carrier when said air inlet opening is radially offset from said stack of plates by a specified angle; and (d) vacuum means for drawing a sufficient volume of air into said air inlet means to pull said forwardmost plate across said predetermined distance into contact with the periphery of said carrier when said air inlet is radially aligned with said stack of plates.

2. The apparatus of claim 1 wherein said means for compressing comprises a positioner which protrudes from the periphery of said carrier.

3. The apparatus of claim 2 wherein said positioner proturdes from the periphery of said carrier by a distance which is slightly greater than said perdetermined distance.

4. The apparatus of claim 2 wherein said positioner comprises a roller.

5. The apparatus of claim 1, including means for removing plates from said carrier.

6. The apparatus of claim 5 wherein said means for removing plates comprises:

(a) one or more closed loop belts;

(b) a first idler roller spaced apart from said carrier, the upper periphery of said first idler roller being generally horizontally aligned with the upper periphery of said carrier; and (c) said belt being arranged to fit tightly around said first idler roller and said carrier and be located under at least a portion of said plates when they are being carried thereon.

7. The apparatus of claim 5 including a second idler roller located above said first idler roller in a manner such that the upper periphery of said first idler roller is separated from the lower periphery of the second idler roller by a distance which is less than the thickness of one of said plates.

* * * * *